United States Patent [19]

Ableitner

[11] 3,945,357

[45] Mar. 23, 1976

[54] SUCTION PIPE ARRANGEMENT IN RECIPROCATING PISTON INTERNAL COMBUSTION ENGINES

[75] Inventor: Erich Ableitner, Hochberg, Germany

[73] Assignee: Daimler-Benz Aktiengesellschaft, Germany

[22] Filed: June 17, 1974

[21] Appl. No.: 480,257

[30] Foreign Application Priority Data

June 22, 1973 Germany ..... 2321755

[52] U.S. Cl. ..... 123/52 M; 123/52 MC

[51] Int. Cl.[2] ..... F02M 35/10

[58] Field of Search ..... 123/52 M, 52 MC

[56] References Cited

UNITED STATES PATENTS

| | | | |
|---|---|---|---|
| 1,373,459 | 4/1921 | Stirton | 123/52 M |
| 1,818,283 | 8/1931 | Spencer | 123/52 M |
| 1,868,355 | 7/1932 | Goldberg | 123/52 M |
| 2,088,983 | 8/1937 | Swennes | 123/52 M |
| 3,800,752 | 4/1974 | Bruderlin | 123/52 M |

*Primary Examiner*—Charles J. Myhre
*Assistant Examiner*—William C. Anderson
*Attorney, Agent, or Firm*—Craig & Antonelli

[57] ABSTRACT

A suction pipe arrangement for reciprocating internal combustion engines with in-line cylinders, in which a common suction pipe with a fastening flange serving for fastening a throttle valve pipe connection is provided for the cylinders, and in which the tuned suction pipes which extend between the cylinder head of the engine and the common suction pipe are subdivided into two groups; the common suction pipe is thereby arranged in the longitudinal direction adjacent the cylinder row approximately at the height of the cylinder head while the first group of tuned suction pipes which branch off from the left portion of the common suction pipe, lead to the right connecting side of the cylinder head and the tuned suction pipes of the second group which branch off from the right portion of the common suction pipe, lead toward the left connecting side of the cylinder head, with each of the tuned suction pipes extending essentially S-shaped.

29 Claims, 4 Drawing Figures

SUCTION PIPE ARRANGEMENT IN RECIPROCATING PISTON INTERNAL COMBUSTION ENGINES

The present invention relates to a suction pipe arrangement in reciprocating piston internal combustion engines with cylinders arranged in a row, i.e., with in-line cylinders, in which a common suction pipe or manifold with a fastening flange serving for fastening a throttle valve connection is provided for the cylinders and in which tuned suction pipes separated into two groups are arranged between the common suction pipe and the cylinder head of the engine.

It is known that the construction and configuration of the tuned suction pipes exert a considerable influence on the engine characteristics. Consequently, tuned suction pipes with relatively great tuning lengths have been proposed heretofore for achieving a higher torque as well as an optimum power output. In order to be able to accommodate such long tuned suction pipes within the engine space, they are so constructed that they lead--depending on the space requirement--from the inlet channel either upwardly or downwardly bent to the common suction pipe or manifold.

However, this construction renders difficult the access to the nozzles, spark plugs and fuel lines. Furthermore, the accommodation of an air filter in unfavorable for spatial reasons because of the arrangement of a throttle valve connection or of an air quantity control device.

The present invention is now concerned with the task to avoid the aforementioned disadvantages and to provide a suction pipe arrangement with smallest space requirement notwithstanding the preservation of the tuned suction pipe lengths customary heretofore. The suction pipe arrangement of this invention should furthermore also be suited for passenger motor vehicle with a particularly flat engine hood.

The underlying problems are solved according to the present invention in that the common suction pipe or manifold is disposed in the longitudinal direction adjacent the cylinder row approximately at the height of the cylinder head and in that the first group of tuned suction pipes which branch off from the left portion of the common suction pipe or manifold—always as viewed from the common suction pipe or manifold toward the cylinder heads—leads to the right connecting side of the cylinder head and in that the second group of tuned suction pipes which are located partially above the first group and branch off from the right portion of the common suction pipe or manifold, leads towards the left cylinder head connecting side or vice versa, with the tuned suction pipes extending S-shaped in each case.

Furthermore, depending on the space conditions within the area of the engine, the fastening flange may be provided at the common suction pipe or manifold at the end thereof either shortly in front of the first or shortly in front of the second group—as viewed in the flow direction. In lieu of these arrangements, the fastening flange may also be arranged in the center of the common suction pipe or manifold—as viewed in the longitudinal direction.

The construction according to the present invention can be further developed in a particularly advantageous manner to the effect that within the area, were the tuned suction pipes of the first group cross with the tuned suction pipes of the second group, both groups are arranged resting one upon the other and in that furthermore an imaginary line extending centrally and transversely between both groups corresponds approximately to the axis of symmetry in relation to the arrangement of the two groups.

In a preferred embodiment according to the present invention, the separating plane disposed between both groups and the horizontal plane extending through the ends of the tuned suction pipes on the side of the engine are inclined to one another—intersecting in the line or axis—in such a manner that the two planes subtend an angle of about 5°.

For purposes of achieving a favorable space requirement, especially for the construction of the common suction pipe or manifold of six cylinder in-line engines with a smaller structural length than the overall length of the connections on the engine side of the tuned suction pipes, the present invention provides that of the three tuned suction pipes of both groups, at least two suction pipes of each group are arranged at the common suction pipe or manifold disposed adjacent one another—as viewed in the longitudinal direction of the common suction pipe or manifold.

For purposes of increasing the flow velocity, the tuned suction pipes are constructed conically whereby the ends of the engine side have the smaller cross-sectional openings.

In order to enable a particularly flat type of construction of the engine hoods, it is additionally proposed according to the present invention that the fastening flange for the throttle valve pipe connection is arranged with its sealing and fastening surface parallel to the horizontal plane and approximately at the height of the separating plane.

In an advantageous construction according to the present invention, the ends of the tuned suction pipes at the engine side may be connected with each other by a common flange and an idling air channel which is constructed as groove and extends over all of the suction pipes may be cast in into the flange.

Accordingly, it is an object of the present invention to provide a suction pipe arrangement for reciprocating piston internal combustion engines which avoids by simple means the aforementioned shortcomings and drawbacks encountered in the prior art.

Another object of the present invention resides in a suction pipe arrangement for reciprocating piston internal combustion engines which assures an extraordinary favorable spatial arrangement enabling ease of access to nozzles, spark plugs and fuel lines.

A further object of the present invention resides in a suction pipe arrangement for internal combustion engines which facilitates the accommodation of an air filter as well as ease of access to the various parts for servicing the engine.

Still a further object of the present invention resides in a suction pipe arrangement for internal combustion engines in which lengths of tuned suction pipes as customary heretofore can be preserved notwithstanding a suction pipe arrangement with extraordinarily small space requirements.

A further object of the present invention resides in a suction pipe arrangement for internal combustion engines of passenger motor vehicles which enables a particularly flat engine hood construction.

These and other objects, features, and advantages of the present invention will become more apparent from the following description when taken in connection with the accompanying drawing which shows, for purposes of illustration only, one embodiment in accordance with the present invention, and wherein.

Figure 1:
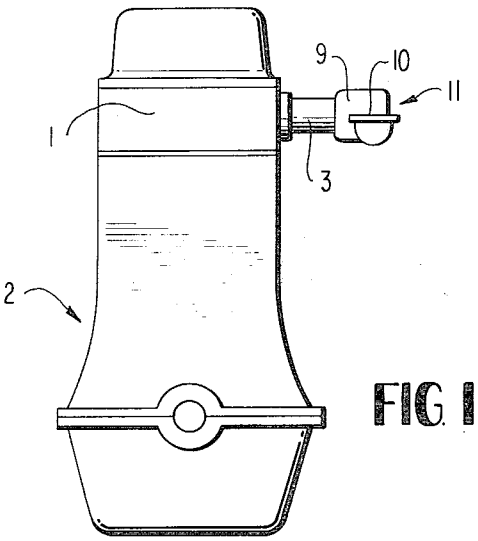
FIG. 1 is a front elevational view of a suction unit in accordance with the present invention, illustrated on an enlarged scale, which consists of tuned suction pipes and a common suction pipe and is secured at the cylinder head of a reciprocating piston internal combustion engine, particularly of in-line construction.

Referring now to the drawing wherein like reference numerals are used throughout the various views to designate like parts, and more particularly to FIG. 1, reference numeral 2 generally designates in this figure a reciprocating piston internal combustion engine with six cylinders of in-line arrangement. A suction unit generally designated by reference numeral 11 which consists of six tuned suction pipes 3 to 8 and of a common suction pipe or manifold 9 with a fastening flange 10 provided for a valve connection—as can be seen from FIGS. 2 and 3—is secured at the cylinder head 1 of the internal combustion engine 2. The tuned suction pipes 3 – 8 are subdivided into two groups, of which the first group consists of the tuned suction pipes 3 to 5 and the second group of the tuned suction pipes 6 to 8.

Figure 2:
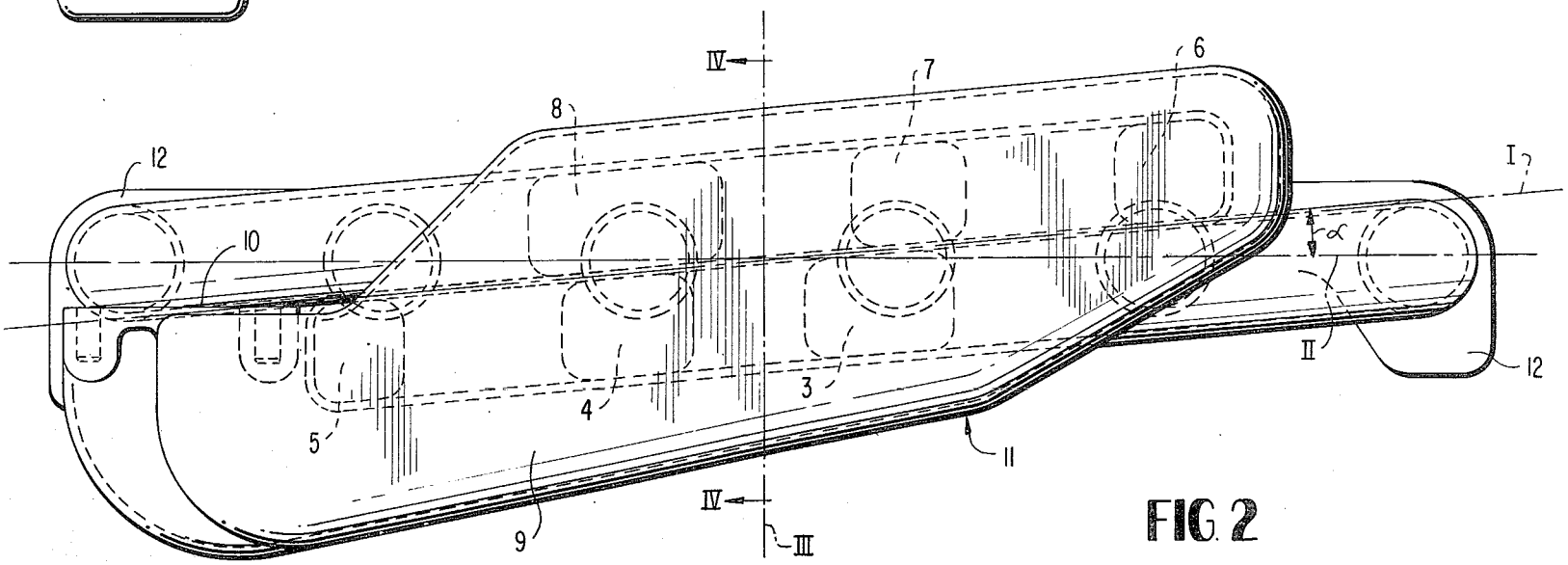
FIG. 2 is a side elevational view of the suction unit according to FIG. 1.
Figure 3:
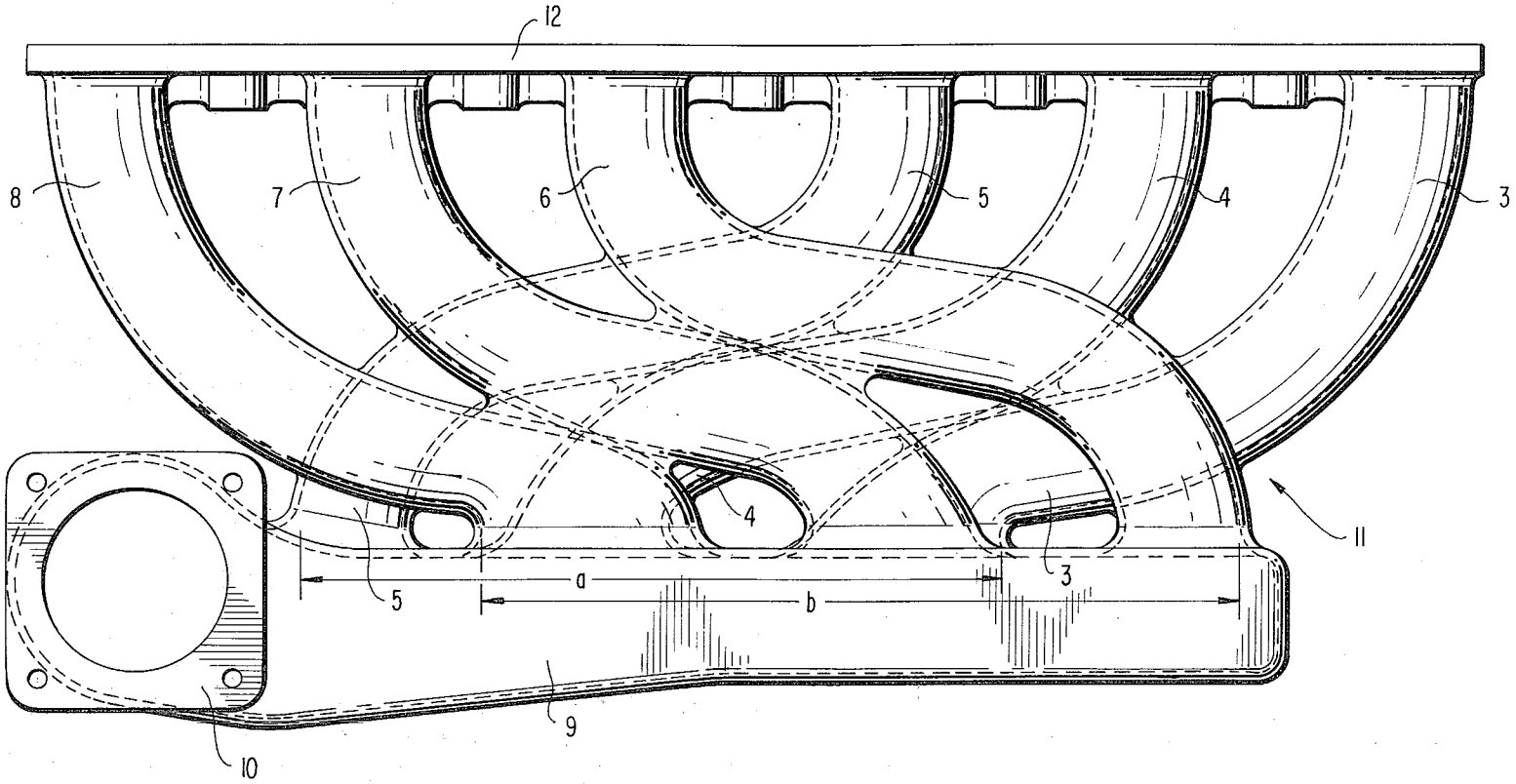
FIG. 3 is a plan view of the suction unit according to FIG. 2.

The tuned suction pipes which are curved S-shaped branch off groupwise in two rows from the common suction pipe or manifold 9 according to FIG. 2 whereby—as can be seen particularly clearly from FIG. 3—the tuned suction pipes 3, 4, 5 of the first group which start from the left section of the common suction pipe or manifold 9 that is disposed shortly behind the fastening flange 10, lead to the right cylinder head connecting side and the tuned suction pipes 6, 7 8 of the second group which start from the right section of the common suction pipe 9, lead to the left cylinder head connecting side. The sections designated by *a* and *b* overlap in such a manner that two of the inwardly disposed tuned suction pipes of both groups, namely the pipes 3, 4 and 7, 8 are disposed mutually opposite one another (FIG. 2). Within the area where the tuned suction pipes 3 to 5 cross the tuned suction pipes 6 to 8, the tuned suction pipes rest directly one upon the other or are disposed one above the other separated by a space (not shown) serving the purpose of preheating the pipes by means of a gas or water. The separating plane disposed between the two groups which in FIG. 2 is designated by reference numeral I and the horizontal plane II extending through the ends of the tuned suction pipes at the engine side, which intersect in an axis III that according to FIG. 3 is simultaneously the axis of symmetry in relation to the arrangement of the two groups, are arranged inclined to one another. The angle $\alpha$ formed by the two planes amounts to about 5°.

The ends of the six tuned suction pipes at the engine side are connected with each other by a common flange 12, into which is cast-in an idling air channel 13 (FIG. 4) extending over the sucton pipes 3 to 8 and constructed as groove.

The tuned suction pipes taper conically in the direction toward the flange 12 in order to achieve higher flow velocities at the cylinder head inlet.

Figure 4:
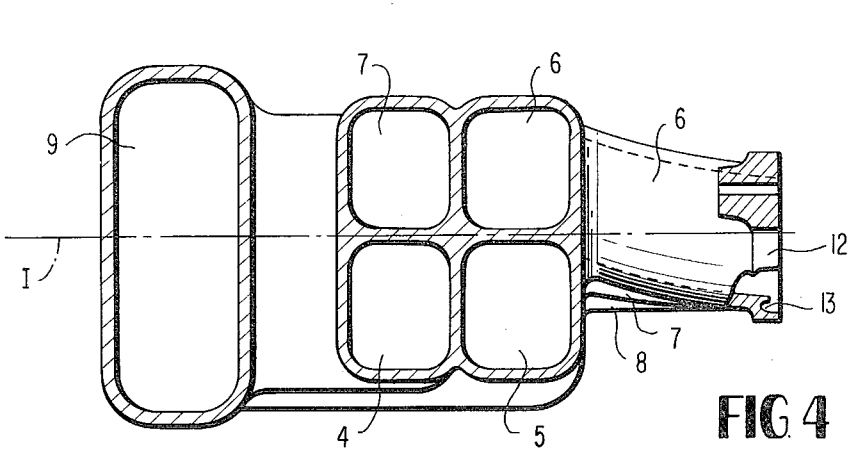
FIG. 4 is a cross-sectional view through the suction unit taken along line IV—IV in FIG. 2.

For technical casting reasons the tuned suction pipes are constructed initially rectangularly shaped beginning with the common suction pipe or manifold 9—as can be seen from FIG. 4—and depending on the requirements pass over shortly in front of the flange 12 into a circular cross section (FIG. 2).

The fastening flange 10 serving for the purpose of fastening the valve connection is arranged with its sealing and fastening surface according to FIG. 1 parallel to the horizontal plane II and approximately at the height of the separating plane I.

The fastening flange 10 may be provided—as viewed in the driving direction of the vehicle—in front of, to the rear of or in the center of the common suction pipe or manifold 9 whereby with a central arrangement, the flange projects laterally from the common suction pipe 9.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

What I claim is:

1. A suction pipe arrangement for reciprocating internal combustion engines with in-line cylinders which includes a common suction pipe means for the cylinders having a fastening flange for the fastening of a valve connection, and tuned suction pipe means extending between the common suction pipe means and the cylinder head of the engine which are subdivided into two groups, characterized in that the common suction pipe means is located in the longitudinal direction adjacent the cylinder row approximately at the height of the cylinder head, and in that the first group of tuned suction pipes which branch off from the left portion of the common suction pipe means—as viewed in each case from the common suction pipe means toward the cylinder head—leads toward the right cylinder head connecting side while the second group of tuned suction pipes which branch off from the right portion of the common suction pipe means lead toward the left cylinder head connecting side, the tuned suction pipes extending substantially S-shaped in each case.

2. A suction pipe arrangement according to claim 1, characterized in that the fastening flange, as viewed in the flow direction, is provided at the common suction pipe means near the end face thereof shortly in front of one of the two groups.

3. A suction pipe arrangement according to claim 2, characterized in that the fastening flange is provided shortly in front of the first group.

4. A suction pipe arrangement according to claim 2, characterized in that the fastening flange is provided shortly in front of the second group.

5. A suction pipe arrangement according to claim 1, characterized in that the fastening flange is arranged substantially in the center of the common suction pipe means, as viewed in the longitudinal direction.

6. A suction pipe arrangement for reciprocating internal combustion engines with in-line cylinders which includes a common suction pipe means for the cylinders having a fastening flange for the fastening of a valve connection, and tuned suction pipe means extending between the common suction pipe means and the cylinder head of the engine, the tuned suction pipe means as subdivided into two groups of tuned suction pipes, characterized in that the common suction pipe means is located in the longitudinal direction adjacent the cylinder row approximately at the height of the cylinder head, and in that the first group of tuned suction pipes which branch off from the left portion of the common suction pipe means, as viewed in each case from the common suction pipe means toward the cylinder head, leads toward the right cylinder head connecting side while the second group of tuned suction pipes which branch off from the right portion of the common suction pipe means leads towards the left cylinder head connecting side, the tuned suction pipes extending substantially S-shaped in each case, and in that within the area in which the tuned suction pipes of the first group cross with the tuned suction pipes of the second group, both groups are arranged on one another.

7. A suction pipe arrangement according to claim 6, characterized in that both groups rest one upon the other within said area.

8. A suction pipe arrangement according to claim 7, characterized in that an imaginary line extending substantially centrally and transversely between both groups corresponds approximately to the axis of symmetry in relation to the arrangement of the two groups.

9. A suction pipe arrangement according to claim 8, characterized in that the separating plane disposed between the two groups and the horizontal plane extending through the ends of the tuned suction pipes on the engine side, intersecting in the imaginary line, are inclined to one another in such a manner that said two planes subtend an angle of about 5°.

10. A suction pipe arrangement according to claim 9, characterized in that three tuned suction pipes are provided in each groups, at least two tuned suction pipes of each group are arranged adjacent one another at the common suction pipe means, as viewed in the longitudinal direction of the common suction pipe means.

11. A suction pipe arrangement according to claim 10, characterized in that the tuned suction pipes are constructed conically whereby the ends of the pipes adjacent the engine side have the smaller flow cross section.

12. A suction pipe arrangement according to claim 11, characterized in that the fastening flange with its sealing and fastening surface is arranged essentially parallel to the horizontal plane and approximately at the height of the separating plane.

13. A suction pipe arrangement according to claim 12, characterized in that the ends of the tuned suction pipes on the engine side are connected with each other by a common flange.

14. A suction pipe arrangement according to claim 13, characterized in that an idling air channel is cast into the flange, said idling air channel being constructed as groove and extending over all tuned suction pipes.

15. A suction pipe arrangement according to claim 13, characterized in that the fastening flange, as viewed in the flow direction, is provided at the common suction pipe means near the end face thereof shortly in front of one of the two groups.

16. A suction pipe arrangement according to claim 15, characterized in that the fastening flange is provided shortly in front of the first group.

17. A suction pipe arrangement according to claim 15, characterized in that the fastening flange is provided shortly in front of the second group.

18. A suction pipe arrangement according to claim 17, characterized in that within the area in which the tuned suction pipes of the first group cross with the tuned suction pipes of the second group, both groups are arranged on one another.

19. A suction pipe arrangement according to claim 18, characterized in that both groups directly rest one upon the other within said area.

20. A suction pipe arrangement for reciprocating internal combustion engines with in-line cylinders which includes a common suction pipe means for the cylinders having a fastening flange for the fastening of a valve connection, and tuned suction pipe means extending between the common suction pipe means and the cylinder head of the engine, the tuned suction pipe means are subdivided into two groups of tuned suction pipes, characterized in that the common suction pipe means is located in the longitudinal direction adjacent the cylinder row approximately at the height of the cylinder head, and in that the first group of tuned suction pipes which branch off from the left portion of the common suction pipe means, as viewed in each case from the common suction pipe means toward the cylinder head, leads toward the right cylinder head connecting side while the second group of tuned suction pipes which branch off from the right portion of the common suction pipe means lead toward the left cylinder head connecting side, the tuned suction pipes extending substantially S-shaped in each case, and in that an imaginary line extending substantially centrally and transversely between both groups corresponds approximately to the axis of symmetry in relation to the arrangement of the two groups.

21. A suction pipe arrangement according to claim 20, characterized in that the separating plane disposed between the two groups and the horizontal plane extending through the ends of the tuned suction pipes on the engine side, intersecting in the imaginary line, are inclined to one another in such a manner that said two planes subtend an angle of about 5°.

22. A suction pipe arrangement according to claim 21, characterized in that the fastening flange with its sealing and fastening surface is arranged essentially parallel to the horizontal plane and approximately at the height of the separating plane.

23. A suction pipe arrangement for reciprocating internal combustion engines with in-line cylinders which includes a common suction pipe means for the cylinders having a fastening flange for the fastening of a valve connection, and tuned suction pipe means extending between the common suction pipe means and the cylinder head of the engine, the tuned suction pipe means are subdivided into two groups of tuned suction pipes, characterized in that the common suction pipe means is located in the longitudinal direction adjacent the cylinder row approximately at the height of the cylinder head, and in that the first group of tuned suction pipes which branch off from the left portion of the common suction pipe means, as viewed in each case from the common suction pipe means toward the cylinder head, leads toward the right cylinder head connecting side while the second group of tuned suction pipes which branch off from the right portion of the common suction pipe means lead toward the left cylinder head connecting side, the tuned suction pipes extending substantially S-shaped in each case, and in that three tuned suction pipes are provided in each group at least two tuned suction pipes of each group are arranged adjacent one another at the common suction pipe means, as viewed in the longitudinal direction of the common suction pipe means.

24. A suction pipe arrangement for reciprocating internal combustion engines with in-line cylinders which includes a common suction pipe means for the cylinders having a fastening flange for the fastening of a valve connection, and tuned suction pipe means extending between the common suction pipe means and the cylinder head of the engine, the tuned suction pipe means are subdivided into two groups of tuned suction pipes, characterized in that the suction pipe means is located in the longitudinal direction adjacent the cylinder row approximately at the height of the cylinder head, and in that the first group of tuned suction pipes which branch off from the left portion of the common suction pipe means, as viewed in each case from the common suction pipe means toward the cylinder head, leads toward the right cylinder head connecting side while the second group of tuned suction pipes which branch off from the right portion of the common suction pipe means lead toward the left cylinder head connecting side, the tuned suction pipes extending substantially S-shaped in each case, and in that the tuned suction pipes are constructed conically whereby the ends of the pipes adjacent the engine side have the smaller flow cross section.

25. A suction pipe arrangement for reciprocating internal combustion engines with in-line cylinders which includes a common suction pipe means for the cylinders having a fastening flange for the fastening of a valve connection, and tuned suction pipe means extending between the common suction pipe means and the cylinder head of the engine, the tuned suction pipe means are subdivided into two groups of tuned suction pipes, characterized in that the common suction pipe means is located in the longitudinal direction adjacent the cylinder row approximately at the height of the cylinder head, and in that the first group of tuned suction pipes which branch off from the left portion of the common suction pipe means, as viewed in each case from the common suction pipe means toward the cylinder head, leads toward the right cylinder head connecting side while the second group of tuned suction pipes which branch off from the right portion of the common suction pipe means lead toward the left cylinder head connecting side, the tuned suction pipes extending substantially S-shaped in each case, and in that the ends of the tuned suction pipes on the engine side are connected with each other by a common flange.

26. A suction pipe arrangement according to claim 25, characterized in that an idling air channel is cast into the flange, said idling air channel being constructed as groove and extending over all tuned suction pipes.

27. A suction pipe arrangemeng for reciprocating internal combustion engines with in-line cylinders which includes a common suction pipe means for the cylinders having a fastening flange for the fastening of a valve connection, and tuned suction pipe means extending between the common suction pipe means and the cylinder head of the engine, the tuned suction pipe means are subdivided into two groups of tuned suction pipes, characterized in that the common suction pipe means is located in the longitudinal direction adjacent the cylinder row approximately at the height of the cylinder head, and in that the first group of tuned suction pipes which branch off from the left portion of the common suction pipe means, as viewed in each case from the common suction pipe means toward the cylinder head, leads toward the right cylinder head connecting side while the second group of tuned suction pipes which branch off from the right portion of the common suction pipe means leads toward the left cylinder head connecting side, the tuned suction pipes extending substantially S-shaped in each case, and in that the separating plane disposed between the two groups and the horizontal plane extending through the ends of the tuned suction pipes on the engine side are inclined to one another in such a manner that said two planes subtend an angle of about 5°.

28. A suction pipe arrangement for a reciprocating internal combustion engine having cylinder head means, the suction pipe arrangement comprising: a common suction pipe means extending in the longitudinal direction of said cylinder head means, a first group of tuned suction pipes branching off from a left portion of the common suction pipe means, as viewed from the common suction pipe means toward the cylinder head means, and extending toward a right portion of said cylinder head means, a second set of tuned suction pipes branching off from a right portion of the common suction pipe means and extending toward a left portion of said cylinder head means, each of said tuned suction pipes of a respective group extending parallel to each other from said cylinder head means to said common suction pipe means.

29. An arrangement according to claim 28, wherein each of said tuned suction pipes of said first and second group separately communicate with said common suction pipe means.

* * * * *

UNITED STATES PATENT OFFICE

CERTIFICATE OF CORRECTION

Patent No. 3,945,357 Dated March 23, 1976

Inventor(s) Erich Ableitner

It is certified that error appears in the above-identified patent and that said Letters Patent are hereby corrected as shown below:

Title page as it reads now:

[30] Foreign Application Priority Data

June 22, 1973 Germany..... 2321755

Title page as it should read:

[30] Foreign Application Priority Data

June 22, 1973 Germany..... 2331755

Signed and Sealed this

Thirteenth Day of July 1976

[SEAL]

*Attest:*

RUTH C. MASON
*Attesting Officer*

C. MARSHALL DANN
*Commissioner of Patents and Trademarks*